US008265317B2

(12) United States Patent
Tseng et al.

(10) Patent No.: US 8,265,317 B2
(45) Date of Patent: Sep. 11, 2012

(54) ELECTRONIC DEVICE

(75) Inventors: Chen Tseng, Tao Yuan Shien (TW); Yi-An Lai, Tao Yuan Shien (TW); Chun-Cheng Lin, Tao Yuan Shien (TW)

(73) Assignee: Quanta Computer Inc., Tao Yuan Shien (TW)

( * ) Notice: Subject to any disclaimer, the term of this patent is extended or adjusted under 35 U.S.C. 154(b) by 269 days.

(21) Appl. No.: 12/877,633

(22) Filed: Sep. 8, 2010

(65) Prior Publication Data

US 2011/0280428 A1 Nov. 17, 2011

(30) Foreign Application Priority Data

May 12, 2010 (TW) ..... 99115075 A

(51) Int. Cl.
*H04R 1/02* (2006.01)
*H04R 9/06* (2006.01)

(52) U.S. Cl. ..... 381/332; 381/386

(58) Field of Classification Search ..... 381/87, 381/150, 332, 334, 386, 387, 388, 395; 181/148, 181/198, 199; 361/679.01, 679.02
See application file for complete search history.

(56) References Cited

U.S. PATENT DOCUMENTS 5,864,519 A * 1/1999 Nakamura ..... 368/10
5,883,966 A * 3/1999 Kubo ..... 381/386
6,529,610 B1 * 3/2003 Ogawa et al. ..... 381/388

* cited by examiner

*Primary Examiner* — Tuan Nguyen
(74) *Attorney, Agent, or Firm* — Thomas|Kayden

(57) ABSTRACT

An electronic device is provided. The electronic device includes a first body, a second body, a speaker cabinet and a link mechanism. The second body rotates relative to the first body by a hinge. The speaker cabinet, disposed in the first body, is selectively lengthened or shortened. The link mechanism connects the hinge with the speaker cabinet. When the second body is closed relative to the first body, the speaker cabinet is concealed in the first body, and when the second body is opened relative to the first body, the hinge drives the link mechanism to press the speaker cabinet, enabling the speaker to be lengthened or to be shortened.

10 Claims, 8 Drawing Sheets

500

ELECTRONIC DEVICE

CROSS REFERENCE TO RELATED APPLICATIONS

This Application claims priority of Taiwan Patent Application No. 099115075, filed on May 12, 2010, the entirety of which is incorporated by reference herein.

BACKGROUND OF THE INVENTION

1. Field of the Invention

The invention relates to an electronic device, and in particular, to an electronic device comprising a retractable speaker cabinet.

2. Description of the Related Art

In a conventional electronic device, the disposition of the speaker is to provide the user with sound effect. The speaker cabinet included by the speaker is utilized to enhance the low frequency effect of the sound to facilitate sound quality. However, in the arrangement of a portable computer, the height of the speaker cabinet is limited by the thickness of the base of the portable computer, and thus an improved performance cannot be achieved. In addition, as development trend of miniaturization, the thickness of the portable computer is designed to be lighter and thinner, such that the volume of the speaker cabinet is further compressed.

BRIEF SUMMARY OF THE INVENTION

Accordingly, an electronic device is provided. The electronic device includes a first body, a second body, a speaker cabinet and a link mechanism. The second body rotates relative to the first body by a hinge. The speaker cabinet, disposed in the first body, is selectively lengthened or shortened. The link mechanism connects the hinge with the speaker cabinet. When the second body is closed relative to the first body, the speaker cabinet is concealed in the first body, and when the second body is opened relative to the first body, the hinge drives the link mechanism to press the speaker cabinet, enabling the speaker to be lengthened or to be shortened.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1A:
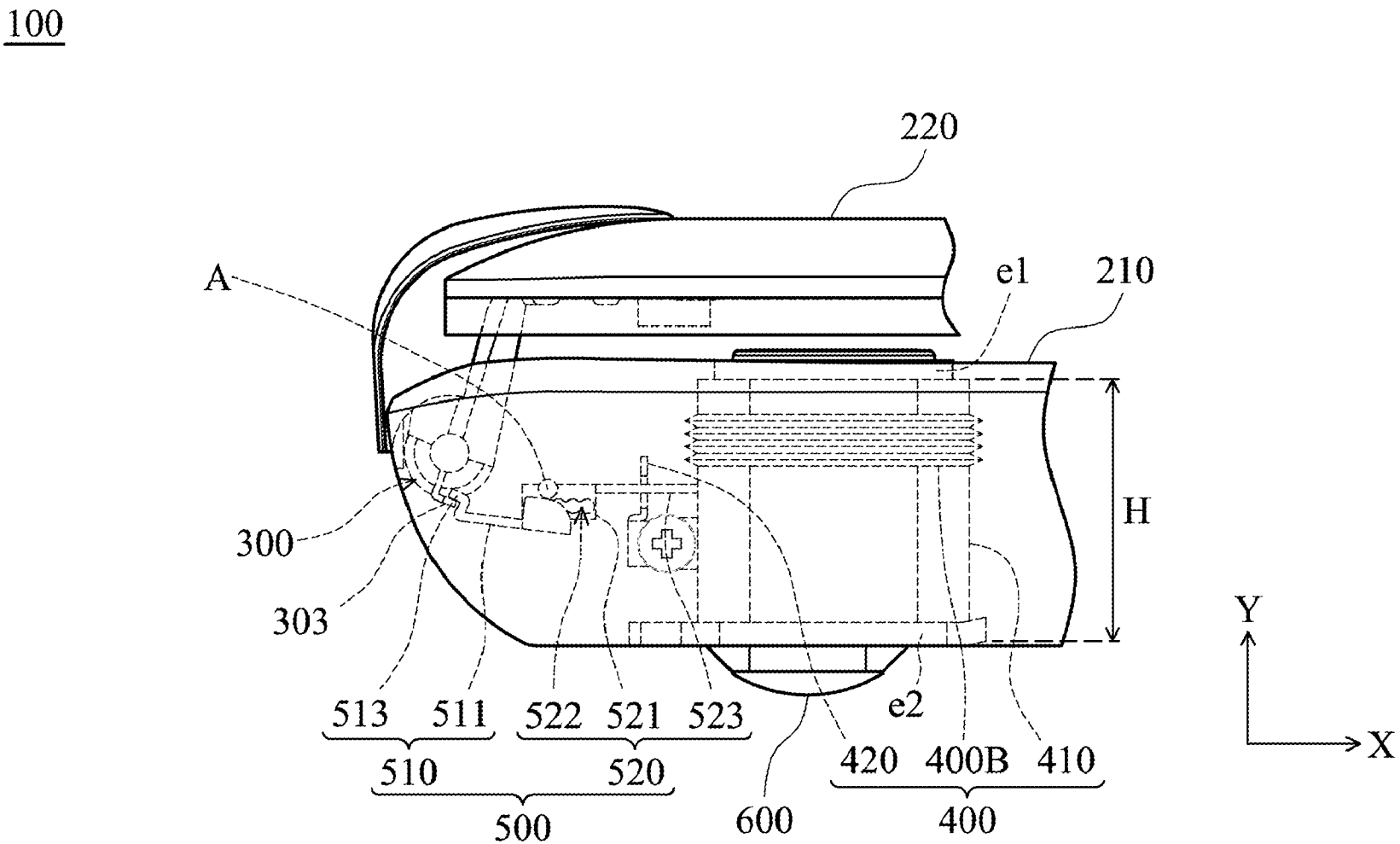
FIGS. 1A to 1C are schematic views of an electronic device of the invention showing the continuous operation of a speaker cabinet.
Figure 1B:
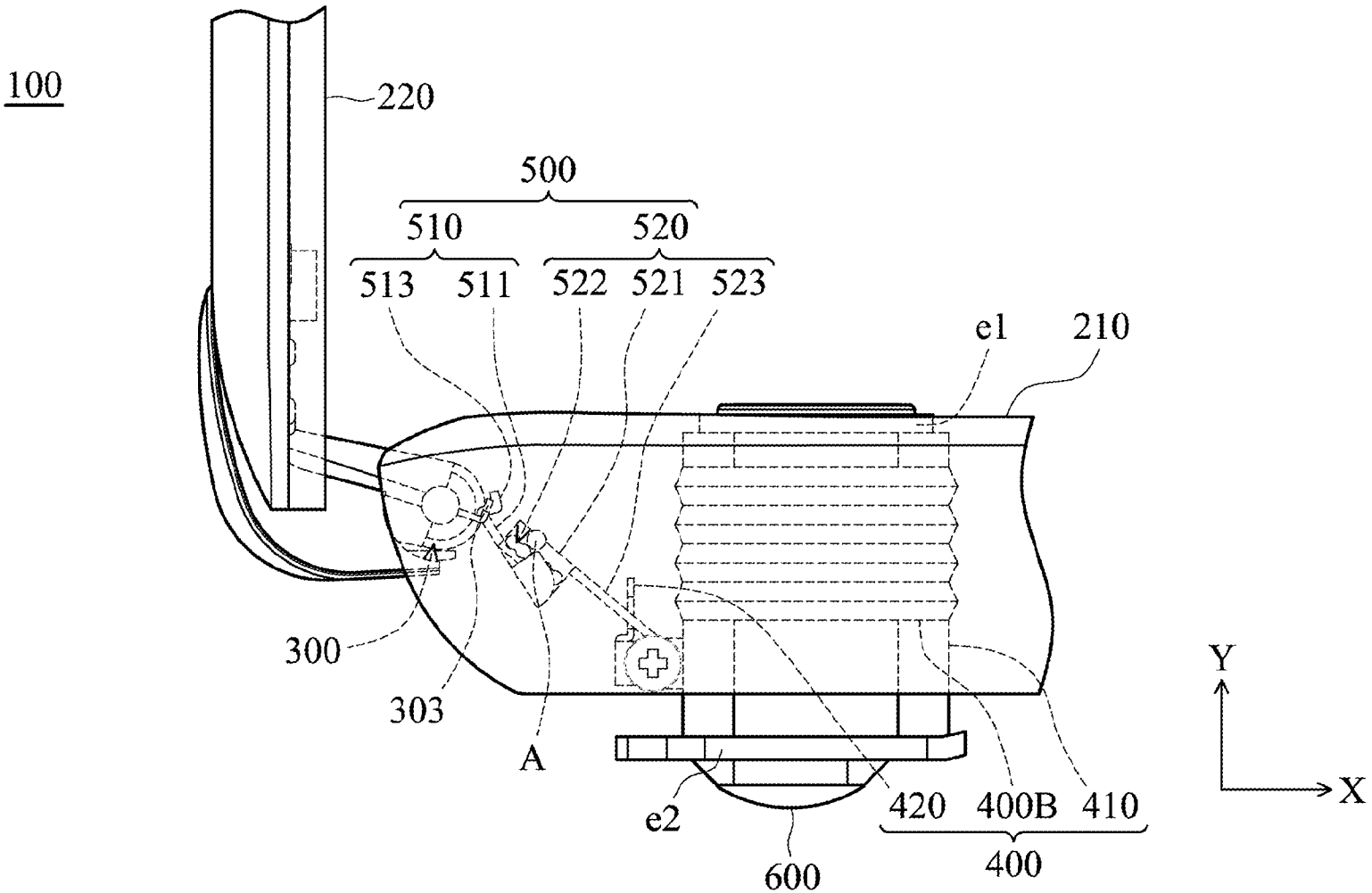
Figure 1C:
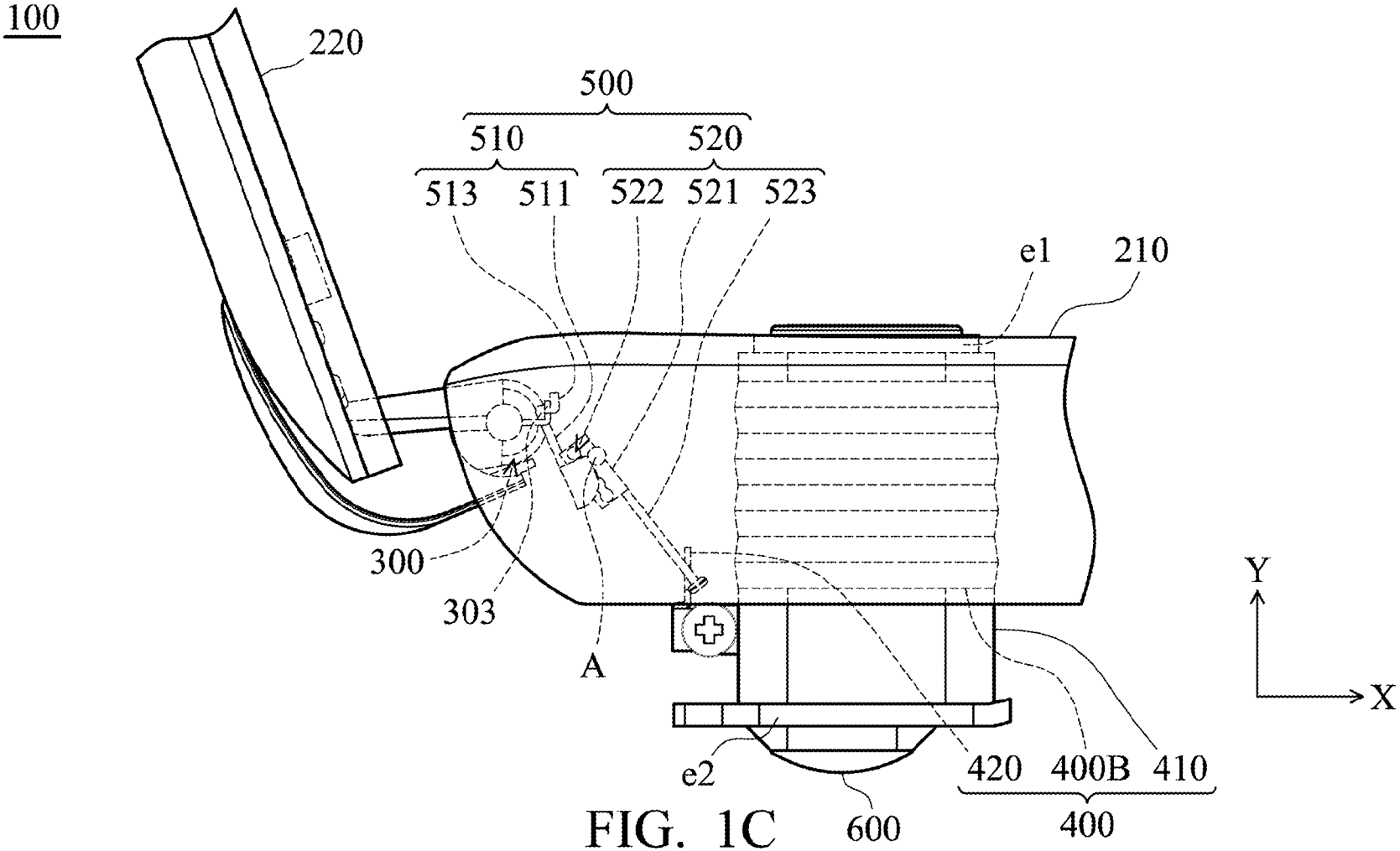

FIGS. 1A to 1C are schematic views of an electronic device of the invention showing the continuous operation of a speaker cabinet. Referring to FIGS. 1A to 1C, the electronic device 100 of the invention, for example a portable computer, comprises a first body 210, a second body 220, a hinge 300, a speaker cabinet 400, a linking mechanism 500 and a pad 600.

The first body 210 and the second body 220 are such as a base (a computer body) and a cover (a display device or a screen) of the portable computer, respectively. The first body 210 and the second body 220 could be relatively opened or closed with each other by the hinge 300. When the first body 210 is closed relative to the second body 220, the speaker cabinet is concealed in the first body 210 (as shown in FIG. 1A), and when the first body is opened relative to the second body 220, a portion of the speaker cabinet 400 is exposed outside of the bottom portion of the first body 210 (as shown in FIGS. 1B and 1C). The pad 600 is disposed on a bottom portion of the speaker cabinet 400 to prevent the damage of the speaker cabinet 400 and to decrease the external impact on the electronic device 100.

The speaker cabinet 400 comprises a top end e1, a bottom end e2, a cabinet body 410 between the top end e1 and the bottom end e2, and an abutting frame 420. A continuously bending structure 400B (a flexible tube) is formed on the cabinet body 410. The top end e1 is fixed on a surface of the first body 210 and the bottom end e2 is movably disposed under the cabinet body 410 and connected with the pad 600. The abutting frame 420, facing the linking mechanism 500, is fixed below the bending structure 400B and connected with the cabinet body 410. When the abutting frame 420 is pushed by the linking mechanism 500 (referring below), the abutting frame selectively presses the bending structure 400B, enabling the cabinet body 410 to be extended (as shown in FIG. 1C, extended position) or retracted (as shown in 1A, retracted position). The extension and the retraction of the bending structure 400B enable a height H of the speaker cabinet 400 to be lengthened or shortened; therefore, the sound quality can be improved by increasing the volume of the speaker cabinet 400 through the variation of the height thereof.

Figure 2A:
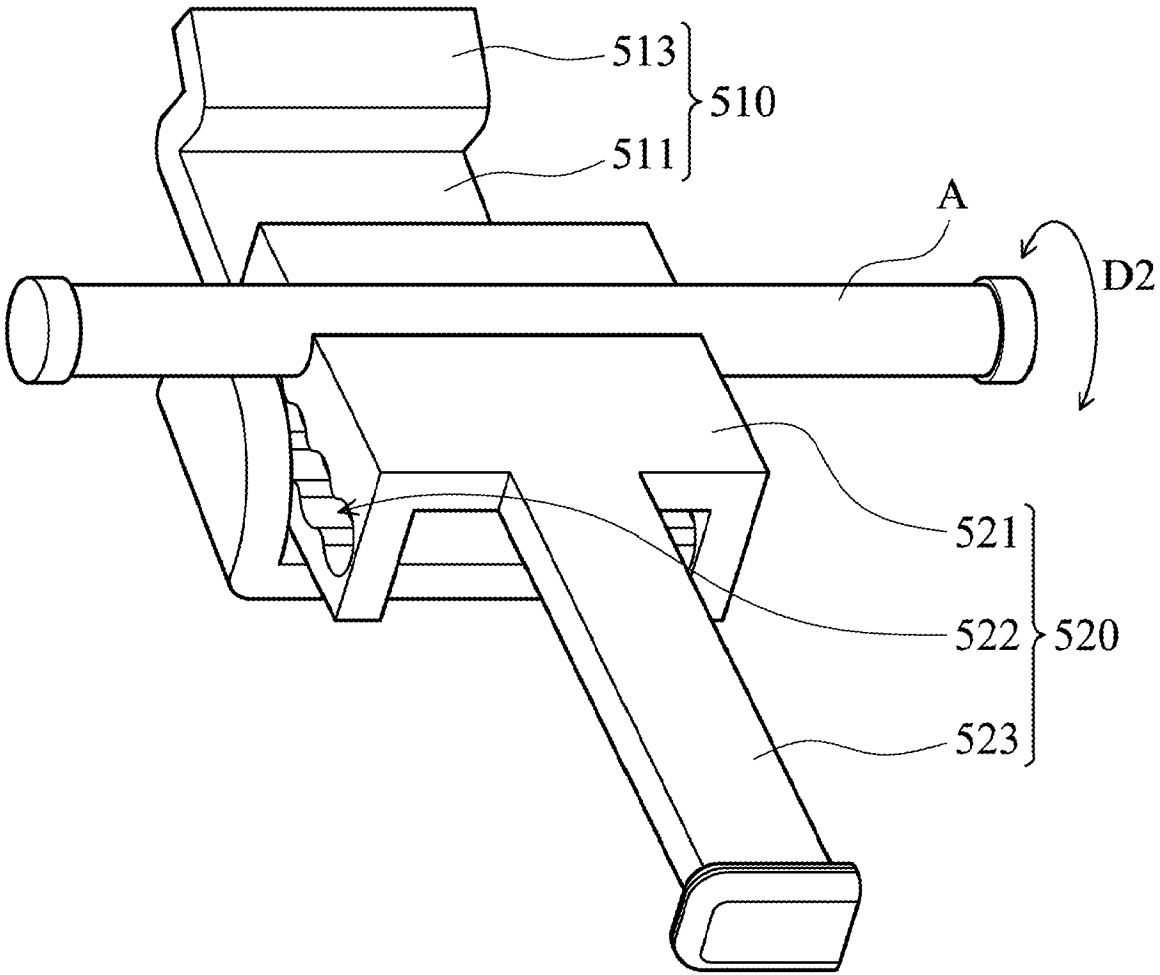
FIG. 2A is a schematic view of a linking mechanism of the electronic device of the invention.
Figure 2B:
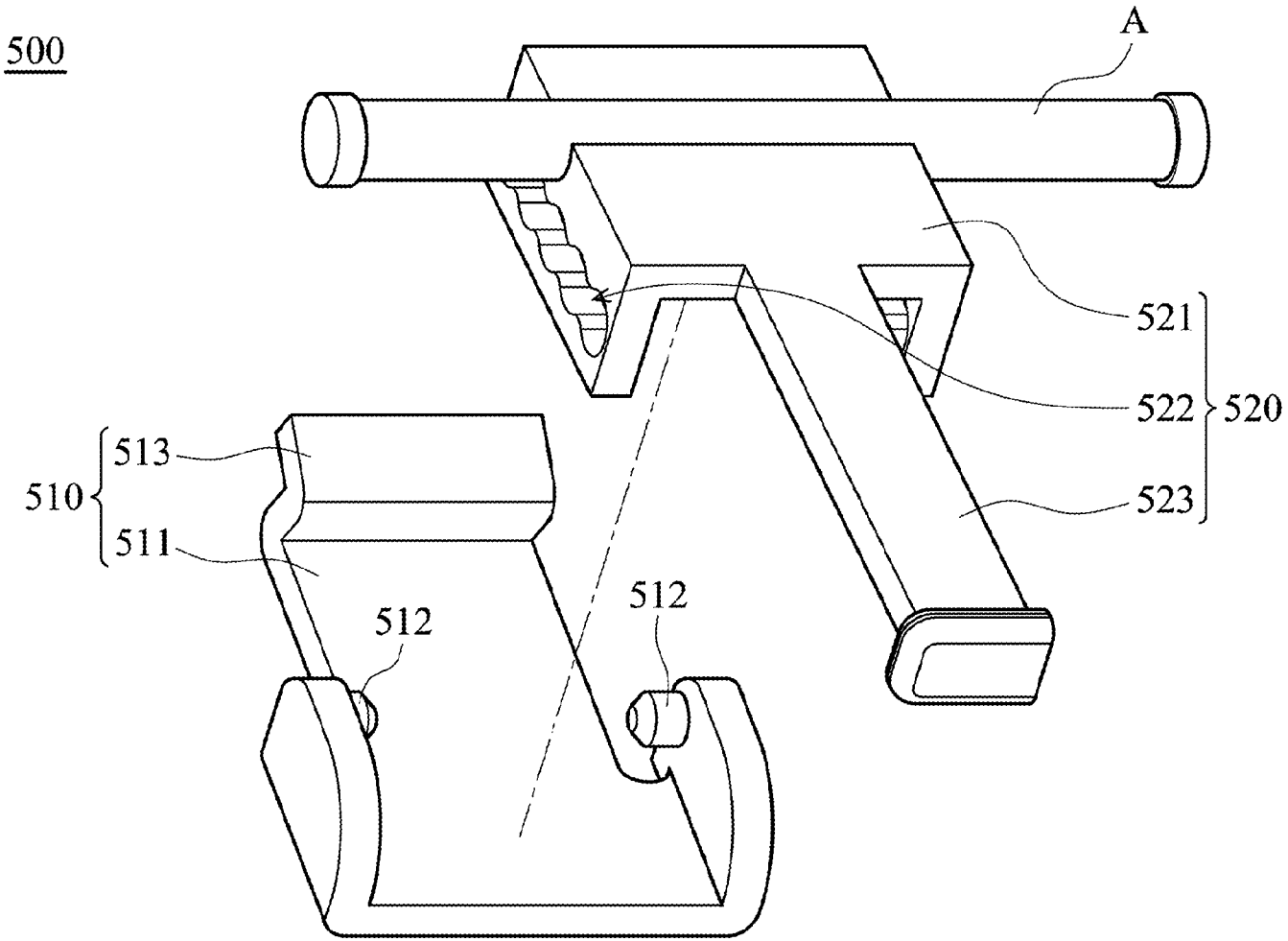
FIG. 2B is an exploded view of the linking mechanism of the electronic device of the invention.
Figure 3:
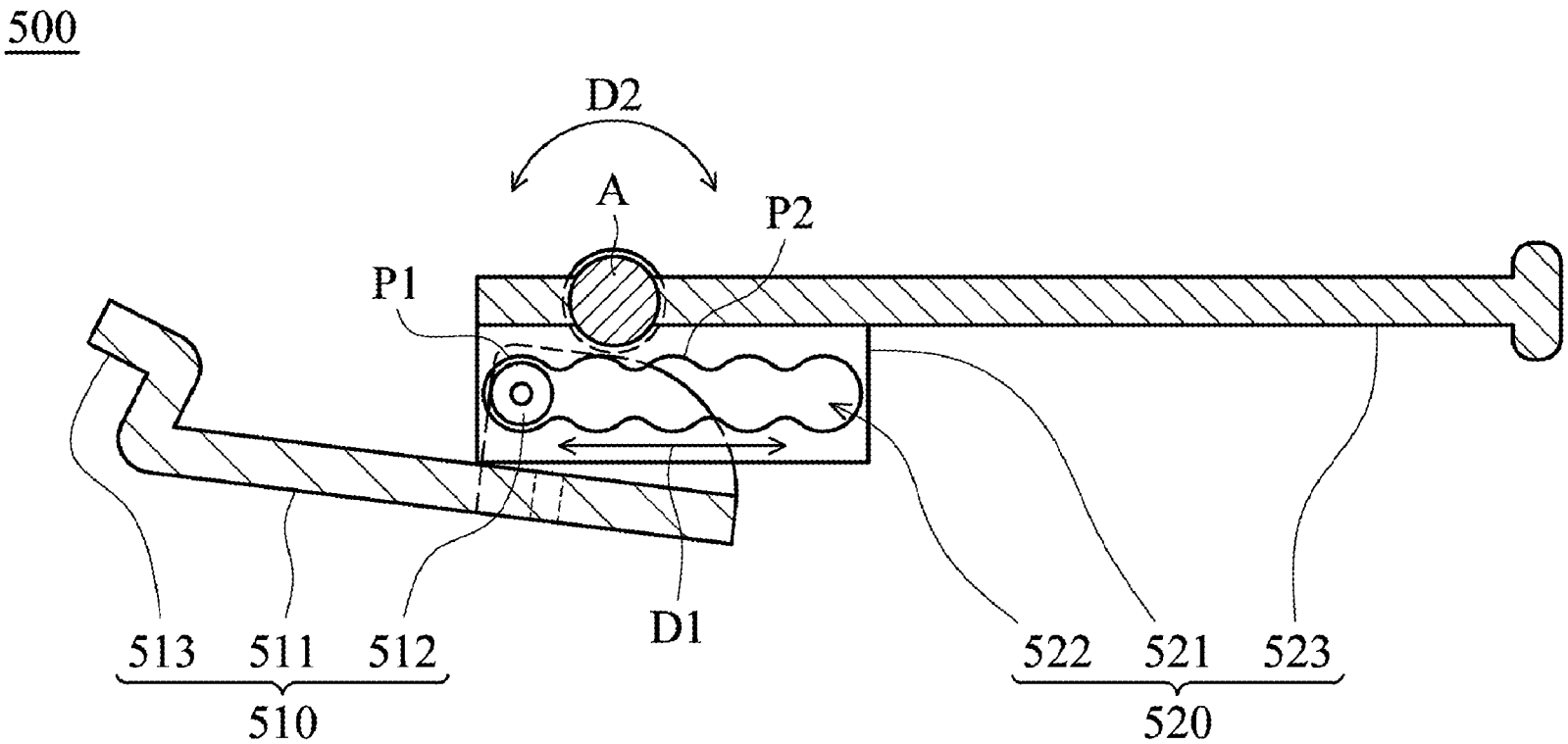
FIG. 3 is a sectional view of the linking mechanism of the electronic device of the invention.

Referring to FIGS. 2A, 2B and FIG. 3. FIG. 2A is a schematic view of a linking mechanism of the electronic device of the invention, FIG. 2B is an exploded view of the linking mechanism of the electronic device of the invention and FIG. 3 is a sectional view of the linking mechanism of the electronic device of the invention. The linking mechanism 500 comprises a first linking member 510 and a second linking member 520. The first linking member 510 comprises a first connecting body 511, a connecting member 512 and a first engage portion 513. The connecting member 512 is disposed on a side of the first connecting body 511, and the first engage portion 513 is disposed on an end of the first connecting body 511 to correspond with the hinge 300. The second linking member 520 comprises a second connecting body 521, a sliding track 522, an abutting member 523 and an axle A. The sliding track 522 is formed on the second connecting body 521 and being corresponded to the connecting member 512. The abutting member 523 is connected with the second connecting body 521 and inserted into the abutting frame 420 for pushing the speaker cabinet 400, such that the height H of the speaker cabinet 400 would be lengthened or shortened. By the engagement between the connecting member 512 and the sliding track 522, the first linking member 510 is connected with the second linking member 520 in a moveable manner. For example, referring to FIG. 3, the first linking member 510 and the second linking member 520 are moved relatively toward the direction D1. Additionally, the axle A is disposed fixedly on the second linking member 520, and mounted on a fixing portion 212 of the first body 210 (as shown in FIG. 4). Thus, with the connection between the first linking member 510 and the second linking member 520, the relatively movement could be achieved through the connection between the connecting member 512 and the sliding track 522. Further-more, because the axle A is mounted on the fixing member 212, the second linking member 520 is able to rotate along the direction D2.

Figure 4A:
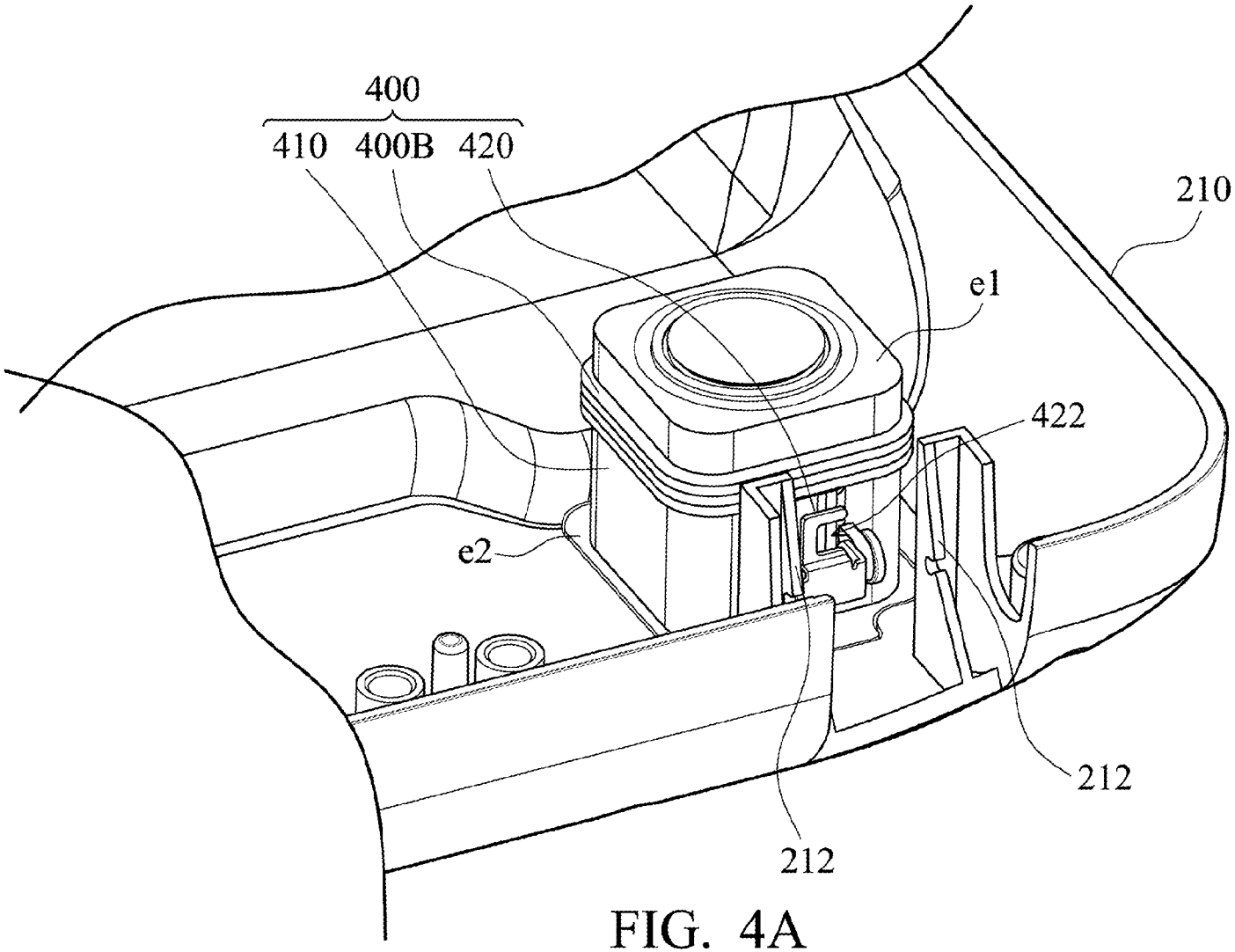
FIG. 4A is a schematic view of a abutting frame of the electronic device of the invention.
Figure 4B:
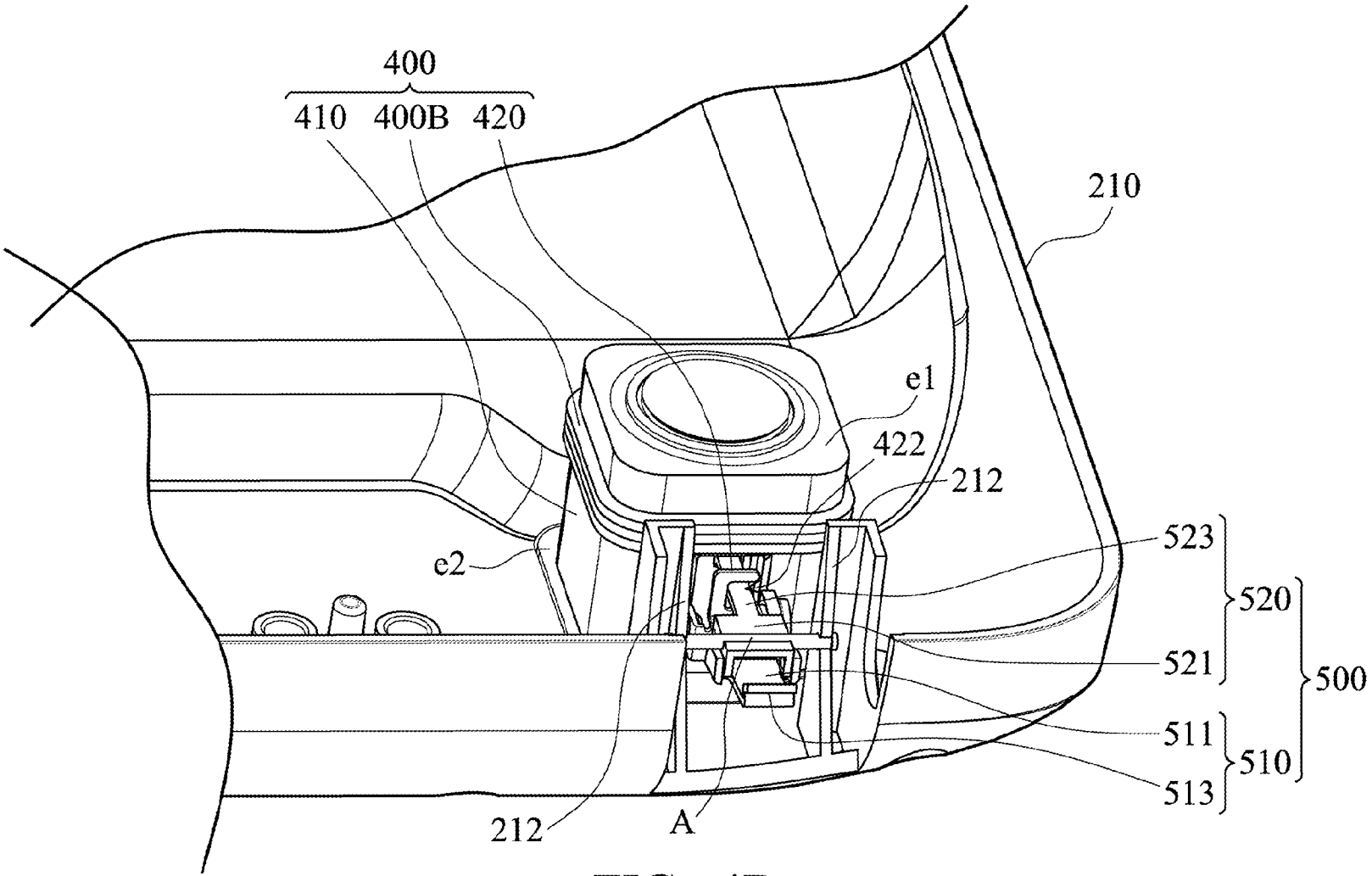
FIG. 4B is a schematic view of the electronic device of the invention showing an abutting member inserting into the abutting frame.

Referring to FIG. 4A and FIG. 4B, where FIG. 4A is a schematic view of a abutting frame of the electronic device of the invention, and FIG. 4B is a schematic view of the electronic device of the invention showing an abutting member inserting into the abutting frame. The abutting frame 420 is fixed on a side of the cabinet body 410 and formed as a U-shaped limiting space 422 to accommodate and limit the abutting member 523 of the second linking member 422. When the abutting member 523 moves in the limiting space 422, the cabinet body 410 connected with the abutting frame 420 is pushed to extend or shorten the bending structure 400B. Moreover, in an embodiment, as shown in FIG. 4B, the fixing member 212 is formed on the first body 210 to support the axle A of the second linking member 520, such that the second linking member 520 is able to move relative to the first body 210.

Referring to FIGS. 1A-1C and 4A-4B, the hinge 300 comprises a second engage portion 303. The first linking member 510 is engaged with the hinge 300 by the engagement of the first engage portion 513 and the second engage portion 303. The second linking member 520 is rotatably disposed in the first body 210 by the axle A, and the abutting member 523 of the second linking member 520 extends into the limiting space 422 of the abutting frame 420 of the speaker cabinet 400.

In detail, referring to FIGS. 1A-1C and FIG. 3 again, when the second body 220 is opened relative to the first body 210, and the hinge 300 is rotated thereby, the second engage portion 303 of the hinge 300 pushes the first engage portion 513, such that the connecting member 512 of the first linking member 510 is moved in the sliding track 522 of the second linking member 520. Once the connecting member 512 slides from an side of the sliding track 522, corresponding to a position below the axle A, to the other side of the sliding track 522 (for example, from the position P1 to the position P2 as shown in FIG. 3), the axle A is forced to rotate due to the lever principle. Simultaneously, the second linking member 520 fixed to the axle A is also rotated (the axle A and the second linking member 520 are rotated clockwise as shown in FIG. 3). Afterwards, due to the rotation of the second linking member 520, the abutting member 523, in the abutting frame 420, of the second linking member 520 is drived to press the abutting frame 420 downward, enabling the cabinet body 410 connected to the abutting frame 420 to extend downward. The bending structure 400B is extended thereby to lengthen the height H of the speaker cabinet 400 so as to increase the volume of the inner space of the speaker cabinet 400.

When the second body 220 is rotated relative to the first body 210 in an opposite direction (to a closed status), the bending structure 400B is forced to a retracted position (compressed) by the weight of the electronic device 100, thereby shortening the height H of the speaker cabinet 400 and allowing the speaker cabinet 400 being concealed within the first body 210 (as shown in FIG. 1A).

The electronic device 100 of the invention is equipped with a retractable speaker cabinet 400. When the second body 220 is opened relative to the first body 210, the height H of the speaker cabinet 400 is lengthened to increase the volume of the speaker cabinet 400, raising the sound efficiency. In the contrary, when the second body 220 is closed relative to the first body 210, the height H of the speaker cabinet 400 is shortened to allow the speaker cabinet 400 being concealed within the first body 210, improving the aesthetic value of the electronic device 100.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An electronic device, comprising:

a first body;

a second body rotating relative to the first body by a hinge;

a speaker cabinet disposed in the first body and selectively being lengthened or shortened; and a link mechanism connecting the hinge with the speaker cabinet;

wherein when the second body is closed relative to the first body, the speaker cabinet is concealed in the first body, and when the second body is opened relative to the first body, the hinge drives the link mechanism to push the speaker cabinet, enabling the speaker to be lengthened or to be shortened.

2. The electronic device as claimed in claim 1, wherein the speaker cabinet comprises a bending structure which enables the speaker cabinet to be lengthened or shortened.

3. The electronic device as claimed in claim 2, wherein the speaker cabinet comprises a flexible tube.

4. The electronic device as claimed in claim 1, wherein the link mechanism comprises:

a first linking member connected with the hinge; and a second linking member rotatably disposed in the first body and connecting the first linking member with the speaker cabinet.

5. The electronic device as claimed in claim 4, wherein the second linking member comprises an axle, the first body comprises a fixing portion, and the axle is mounted on the fixing portion to enable the second linking member to be disposed in the first body in a rotatable manner.

6. The electronic device as claimed in claim 4, wherein the first linking member further comprises a first engage portion, the hinge comprises a second engage member abutting the first engage member, and when the second body is opened relative to the first body, the second engage member pushes the first engage member.

7. The electronic device as claimed in claim 6, wherein the first linking member further comprises a connecting member, and the second linking member comprises a sliding track corresponding to the connecting member, and the connecting member is movable relative to the second linking member through engagement between the connecting member and the sliding track.

8. The electronic device as claimed in claim 7, wherein the second linking member further comprises an abutting member, the speaker cabinet comprises a abutting frame for the abutting member inserted within, and when the second body is opened relative to the first body, the abutting member presses the abutting frame to allow a portion of the speaker cabinet extending out of the first body.

9. The electronic device as claimed in claim 1, wherein the first body comprises a base, and the second body comprises a cover.

10. The electronic device as claimed in claim 1, further comprising a pad disposed on a bottom portion of the speaker cabinet.

* * * * *